US005351454A

United States Patent [19]

Hähne et al.

[11] Patent Number: 5,351,454

[45] Date of Patent: Oct. 4, 1994

[54] SELF-SUPPORTING FACADE COMPONENT IN SANDWICH CONSTRUCTION

[75] Inventors: Helfried Hähne, Kelheim; Johann-Dietrich Wörner, Darmstadt, both of Fed. Rep. of Germany

[73] Assignee: Hoechst Aktiengesellschaft, Fed. Rep. of Germany

[21] Appl. No.: 705,514

[22] Filed: May 24, 1991

Related U.S. Application Data

[63] Continuation of Ser. No. 467,862, Jan. 22, 1990, abandoned.

[51] Int. Cl.[5] ..... E04B 2/26; E04B 1/40

[52] U.S. Cl. ..... 52/309.17; 52/309.11; 52/309.12; 52/309.14; 52/405.1; 52/602; 52/612; 52/809

[58] Field of Search ..... 52/612, 809, 309.11, 52/309.13, 309.14, 309.9, 602, 405, 309.12, 309.17

[56] References Cited

U.S. PATENT DOCUMENTS

| | | | |
|---|---|---|---|
| 1,417,553 | 5/1922 | Muench | 52/405 |
| 1,938,215 | 12/1933 | Corcoran | 52/602 |
| 1,963,410 | 6/1934 | Kartowicz | 52/602 |
| 2,182,470 | 12/1939 | Froman | 52/405 |
| 2,194,047 | 3/1940 | Markle | 52/405 |
| 4,133,928 | 1/1979 | Riley et al. | 52/309.17 |
| 4,229,497 | 10/1980 | Piazza | 52/309.12 |
| 4,541,211 | 9/1985 | Garrett | 52/405 |
| 4,551,959 | 11/1985 | Schmid | 52/405 |
| 4,879,855 | 11/1989 | Berrenberg | 52/309.11 |
| 4,986,049 | 1/1991 | Kennedy et al. | 52/405 |

*Primary Examiner*—Michael Safavi
*Attorney, Agent, or Firm*—Connolly & Hutz

[57] ABSTRACT

A self-supporting façade component in sandwich construction, composed of at least two self-supporting layers and at least one interposed insulating layer, is metal-free, the self-supporting layers being composed of fiber-reinforced concrete and the layers being positively fixed to one another by non-metallic fixing means (preferably plastic anchors).

7 Claims, 1 Drawing Sheet

SELF-SUPPORTING FACADE COMPONENT IN SANDWICH CONSTRUCTION

CROSS REFERENCE TO RELATED APPLICATION

The present application is a continuation of application Ser. No. 467,862 filed Jan. 22, 1990, now abandoned.

The present invention relates to a self-supporting façade component in sandwich construction, composed of at least two self-supporting layers and at least one interposed insulating layer, which component is essentially metal-free and therefore shows good heat insulation and, if appropriate, sound insulation and does not reflect electromagnetic waves, for example radar beams.

The present invention also relates to a process for producing these facade components and to their use for erecting and facing building structures which must not, or only slightly reflect electromagnetic waves, for example radar beams.

Particularly in areas where radar guidance systems are installed, it is frequently desirable to erect only buildings of such a type that they do not reflect radar beams. It is already known to achieve this object by covering conventional reinforced concrete structures with thick coatings of radar-absorbing materials and—if these materials are not themselves weather-resistant—also to apply an additional weather-resistant facing to the outside.

German Offenlegungsschrift 2,939,877 has disclosed a composite sandwich panel (for the construction sector) which is composed of 2 thin-walled outer shells which are solidly connected by non-rusting tie anchors and in which the cavity between the outer shells is filled with an insulating material which has recesses in a parallel and mutually offset arrangement.

The two outer shells (1) are thinner than 1.5 cm, and the insulating material firmly embedded between the outer shells can have any desired thicknesses.

In a preferred embodiment, the outer shells are composed of fine concrete reinforced with non-rusting fibers or fiber fabrics.

However, such composite panels show strength values which as a rule are not adequate for a self-supporting type of facade construction within the meaning of this invention, i.e. without stabilization by a metallic supporting structure. Even with fiber reinforcement of an outer shell, these panels can therefore be used only to a restricted extent.

The necessity of additionally using metallic building materials, for example also metallic tie anchors, has the result that such panels are unsuitable for the erection of building structures which do not reflect electro-magnetic waves.

These hitherto known solutions are therefore either expensive to put into engineering practice and therefore represent a high cost factor or they are unable in principle to achieve the object. There was therefore an urgent demand for a self-supporting façade component which can be produced relatively simply and processed conveniently, and which at the same time meets all the requirements with regard to mechanical strength, weather-resistance, heat and sound insulation as well as freedom from reflection of electromagnetic waves.

The present invention provides such a façade component.

The self-supporting facade component according to the invention has a multi-layer structure (sandwich type of construction) of at least two self-supporting layers and at least one insulating layer located between these, which component is essentially and preferably completely metal-free, the self-supporting layers being composed of fiber-reinforced concrete and the layers being positively fixed to one another by essentially and preferably completely metal-free fixing means. Within the meaning of the present invention, the term concrete also comprises lightweight concrete.

The function of the load-bearing layer of the facade component according to the invention is to confer a high mechanical strength to the component, especially to provide it with such a high flexural tensile strength that the component can be assembled with identical or different building components to give stable, self-supporting building walls. In principle, the façade component according to the invention requires only one load-bearing layer but, for particularly stringent demands on the stability or if special designs have to be mastered statically, it can be advantageous to provide two or more load-bearing layers, insulating layers being located between each of these. Such multi-layer structures show, in addition to the increased static stability, particular advantages with respect to sound and heat insulation. For a further improvement in the static properties of the façade component according to the invention, the load-bearing layer or layers can be considerably further increased by known shaping measures, for example by reinforcing ribs. As a rule, one load-bearing layer is sufficient to confer the requisite stability on the façade component according to the invention. Façade components having one load-bearing layer, i.e. having a three-layer structure, are therefore preferred.

The function of the facing layer is predominantly a protective function for the structure located underneath. The facing layer must therefore have the highest possible unsusceptibility to shrinkage cracking, weather resistance and frost resistance. This function can also be additionally supported by shaping measures, for example by forming the edge portions in such a way that the facing shells of adjacent and superposed façade components according to the invention engage like scales above or into one another.

For the strength of the self-supporting layers, i.e. the load-bearing layer and the facing layer, the composition of the fiber-reinforced concrete, of which these layers are made, is of prime importance. The properties corresponding to the abovementioned functions of these layers (also called shells), such as weather resistance, frost resistance and unsusceptibility to shrinkage cracking for the facing layer and load-bearing capacity and unsusceptibility to shrinkage cracking for the load-bearing layer, are essentially determined by the composition of the fiber-reinforced concrete, of which these layers are composed. In principle, allknown compositions which meet the said specifications can be used as the concrete matrix for the facing shell and the load-bearing shell. As is known, such formulations are composed of an inorganic or organic binder, aggregates such as, for example, gravel, sand, chippings, fly ash and, if appropriate, additives such as, for example, plasticizers, pore formers and the like. The inorganic binders which can be used are above all the various grades of cements, but also, for example, gypsum or sulfur, and the organic binders used can be essentially epoxide resins, polyester resins or PCC resins. The binders and aggregates are advantageously present in the concrete in a ratio from 1:3 to 1:8. The additives are as a rule added to the concrete in a proportion of up to 5% by weight of the concrete mix. Detailed data on the preparation of suitable concrete mixes, using inorganic or organic binders, are to be found, for example, in:

Lueger, Lexikon der Technik [Dictionary of Technology], Deutsche Verlagsanstalt Stuttgart, (1966) Volume 10, pages 180 et seq.; Volume 11, pages 739 et seq., Meyers Handbuch über die Technik [Meyer's Technology Handbook], Bibliographisches Institut, Mannheim/Wien/Zürich (1971), pages 136 et seq., Ullmann's Encyclopedia of Industrial Chemistry, Volume 15, pages 516–533, Polymers in Concrete, American Concrete Society, Detroit 1978, Spec. Publ. SP 58.

Within the limits given above, the composition of the concrete mix is selected in a manner known per se in accordance with the required specifications.

The properties of the concrete mix are also determined to a considerable extent by the proportion of fibers contained therein.

The fibers can be contained in the fiber-reinforced concrete either as continuous individual filaments or cut in staple lengths from 2 to 60 mm, preferably 6 to 12 mm, and can be homogeneously or inhomogeneously distributed therein, preferably with a controlled inhomogeneity, or they can be in the form of continuous yarns or fiber yarns of hanks or rods, or in the form of flat textile structures such as woven fabrics, knitted fabrics or nonwovens and the like.

A homogeneous distribution of the fiber materials across the thickness of the self-supporting layers made of the fibrated concrete is most easily accomplished with continuous or staple fibers which are added to the concrete mix and uniformly admixed thereto. For thicker layers, especially for the load-bearing layer, it can be advantageous to increase the fiber proportion in the vicinity of the surfaces of these layers, because it is there that the greatest forces arise in the case of a bending stress. Such a controlled inhomogeneity with the use of individual fibers can be produced, for example, by preparing two concrete mixes with different fiber proportions and layering these in the desired manner one above the other and allowing them to set. When fiber products in the form of yarns, hanks, rods, woven fabrics, knitted fabrics or nonwovens are used, these materials can of course be introduced in a controlled manner into those zones of the self-supporting building components which are to be particularly preferentially reinforced. Thus, for example, fiber hanks or fiber rods can be cast in in a horizontal parallel arrangement or also in a crossed arrangement in the vicinity of the two surfaces of the self-supporting building components. Of course, it is also possible additionally to reinforce the more neutral internal zones of the building component by fiber materials.

The fiber proportion in the fiber-reinforced concrete of the façade components according to the invention is on average 0.1 to 10, preferably 0.3 to 2 and especially 0.5 to 1%by volume. Because of the different mechanical stresses on the facing layer and the load-bearing layer of the façade component, the added quantities of the fiber material can be adapted within the range of the above limits. Thus, only 0.3 to 0.6% by volume of fiber material are preferably used in the facing shell, but preferably 1 to 2% by volume of fiber material are used in the load-bearing shell.

The chemical nature of the fiber material is also of special importance for the static properties of the façade component according to the invention. The fibers used should be resistant to chemicals, in particular resistant to acid and alkali, resistant to elevated temperatures and corrosion-resistant they should show good bonding behavior in the matrix and not involve any health hazards. These specifications are best met by synthetic fibers such as, for example, fiber materials of polyacrylonitrile, polypropylene, polyester, polyamide, aramide and carbon fibers. For alkaline concrete mixes, polyacrylonitrile fibers are preferably used, and also polyester fibers, advantageously of polyesters with masked end groups. Polyacrylonitrile fibers and polyester fibers can likewise be preferably used for PCC concrete. Numerous grades of fiber materials of the said type are commercially available, and it is advantageous to use high-strength grades for reinforcing the concrete mixes. In particular, high-strength, homopolymeric, so-called technical polyacrylonitrile fibers such as, for example, ®Dolanit, which are therefore particularly preferred in producing the façade components according to the invention, can be universally used. Depending on the count, such technical fibers have twice to three times the initial moduli and final strengths of the corresponding textile fibers and therefore show far superior reinforcing properties.

The porous insulating layer of the façade components according to the invention can in principle be produced from all known porous insulating materials. Both soft, flexible materials and dimensionally stable, hard materials can be used. These can be, for example, fiber mats, in particular those of inorganic fibers, such as rock wool mats or glass fiber mats, preferably those which have been consolidated by addition of a binder, or also foams such as, for example, flexible foam of latex materials, but preferably rigid foams such as, for example, polystyrene foam, glass foams or polyurethane foams. Rigid foam slabs which are in turn fiber-reinforced are also particularly preferred, in particular those which have a high mechanical strength due to the incorporation of three-dimensional fiber structures.

As already stated above, the façade components according to the invention preferably have a three-layer structure comprising a load-bearing layer, an insulating layer and a facing layer. The thickness of the individual layers is selected in accordance with their functions specified above. The thickness of the load-bearing layer is therefore adapted to the requirements of statics, taking into account the strength properties of the fiber-reinforced concrete, and the thickness of the facing layer and of the insulating layer is selected in accordance with the required protecting and insulating properties.

The following thickness ranges proved to be advantageous, especially in the case of a three-layer structure of the façade component: 8 to 30 cm for the load-bearing layer, preferably 10 to 20 cm, depending on the static requirements, 3 to 8 cm for the facing layer, preferably 4 to 6 cm, and 2 to 30 cm for the insulating layer, preferably 5 to 15 cm.

The individual layers of the façade component according to the invention are positively joined to one another. The joining of the layers must be so firm that it withstands all shear forces and delamination forces which arise during production, processing and in later use. Particularly in the finished building, the positive joining must absorb the force of the facing layer's own weight and the wind suction forces applying thereto. All known means which give the required strength can be used as joining means for the layers. Thus, if an appropriately solid, dimensionally stable insulating material and a relatively lightweight placing shell are selected, adhesive bonding of the three layers is possible. Positive joining of the individual layers of the façade component according to the invention by essentially or preferably completely metal-free anchors, which penetrate all the layers of the façade component and are firmly anchored in the fibrate concrete layers, is independent of the mechanical properties of the insulating layer and is therefore preferred. The material used for these preferably metal-free anchors is advantageously a fiber-reinforced plastic having a high tensile strength, flexural tensile strength and shear strength. For irreleasable fixing of the anchor in the fibrate concrete layers, the anchor shows at least one change in its form, for example a bend or a change in its diameter, in regions where it is located in the fibrate concrete layer. Other possibilities of fixing the anchors in the fibrate concrete layers of the façade component according to the invention are also possible. Thus, for example, anchors which penetrate all the layers of the façade component can be splayed and hence fixed in the zones of the fibrate concrete layers. Glueing of the anchors in the zone of the fibrate concrete layers by appropriate high-strength adhesives is also possible for fixing the anchors in the concrete layers. The anchors are uniformly distributed over the surface of the façade component according to the invention, so that all the anchors are approximately uniformly loaded by the forces which are to be transmitted. The number of anchors naturally depends on the magnitude of the forces to be transmitted and on the stability of the anchor elements. Advantageously, anchors which predominantly have to absorb the wind suction forces are substantially perpendicular to the surface of the façade component according to the invention; by contrast, the direction of anchors which predominantly absorb the force of the facing shell's own weight has the largest possible vertical component, which means that these anchor elements are in an oblique position, inclined in the direction of the vertical, in the façade component.

In an alternative possibility of degrading the force of the facing shell's own weight, the facing layer and the load-bearing layer adjoining it have horizontal shoulders which are mutually offset in height and protrude into the interspace between the two layers and which are superposed in such a way that the force of the facing layer's own weight is transmitted from its shoulder through the material of the insulating layer to the shoulder of the load-bearing layer. This design of course presupposes a corresponding load-bearing capacity of the insulating material. Of course, the facing layer and the adjoining load-bearing layer can also have a plurality of horizontal shoulders which are spaced in height and are mutually associated for force transmission. The projection of the shoulders is chosen such that they correspond to about $\frac{2}{3}$ to $\frac{3}{4}$ of the thickness of the insulating layer. This has the consequence that, on the one hand, no serious cold bridges are formed and, on the other hand, that there is a sufficient overlap of the shoulders for transmitting the force of the facing layer's own weight. The cross-section of the shoulders can in principle be selected as desired, for example rectangular or triangular, but its thickness must be sufficient to transmit the forces which arise. A triangular or trapezoidal cross-section has the advantage that the region in which the insulating layer is thinner can be kept relatively small.

BRIEF DESCRIPTION OF DRAWINGS

FIGS. 1 and 2 serve to illustrate preferred embodiments of the present invention. FIG. 1 diagrammatically shows an oblique top view of a façade component according to the invention with partially removed individual layers, which element is composed of a load-bearing layer (1), a facing layer (2) and an insulating layer (3) and which contains anchors (4) for positive joining of the layers.

FIG. 2 diagrammatically shows an oblique top view of a façade component according to the invention with partially removed individual layers, which element is composed of a load-bearing layer (1), a facing layer (2) and an insulating layer (3) and which contains anchors (4) and horizontal shoulders (5) for positive joining of the layers.

Figure 1:
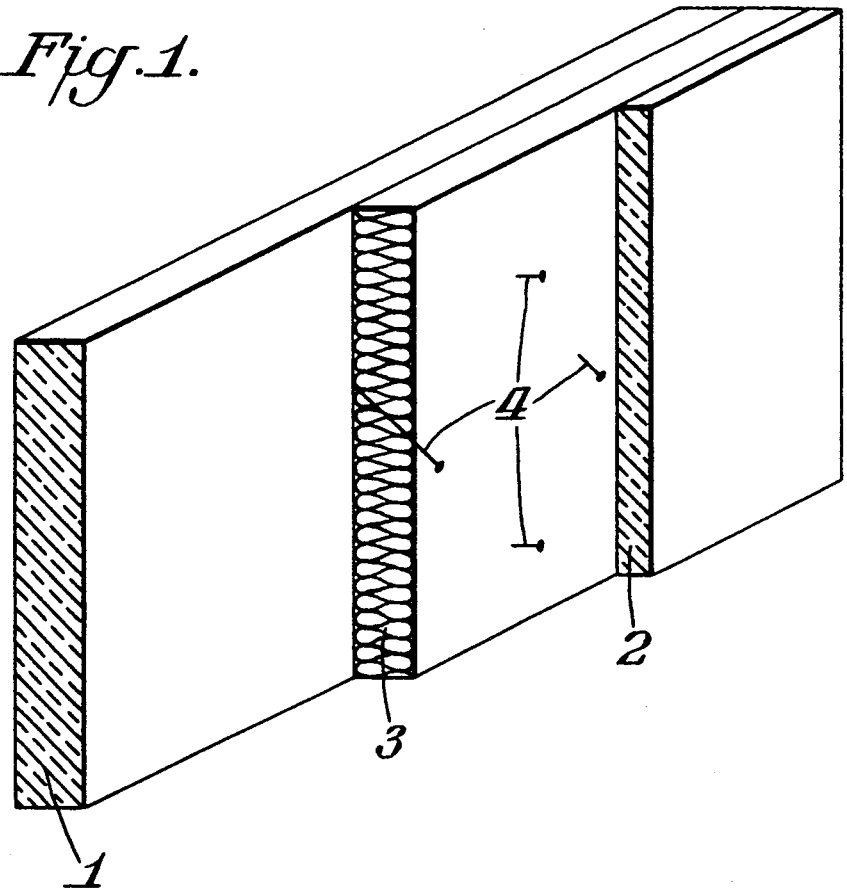
FIG. 1 is a diagrammatic perspective view of a façade component, according to the present invention.
Figure 2:
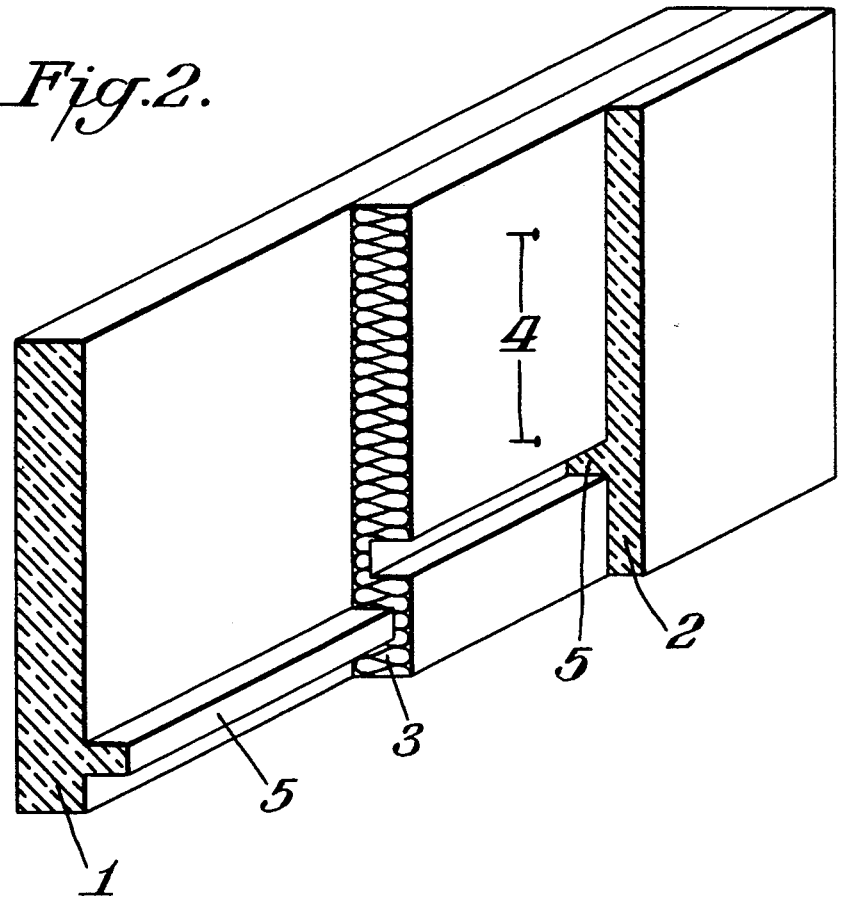
FIG. 2 is a diagrammatic perspective view of another façade component according to the present invention.

Those façade components according to the invention are particularly preferred which combine several of the abovementioned preferred features. Thus, for example, a self-supporting façade component according to the invention composed of a load-bearing layer, a facing layer and an interposed insulating layer is particularly preferred which is completely metal-free, the load-bearing layer and the facing layer being composed of fiber-reinforced concrete, in particular cement concrete, the reinforcing fibers being in the form of staple fibers having a staple length from 2 to 60 mm and being composed of polyacrylonitrile, and the three layers being positively joined to one another by means of plastic anchors.

The façade component according to the invention is produced in such a way that at least 2 self-supporting flat components of fiber-reinforced concrete are positively joined to one another by interlayers of porous insulating material. When a dimensionally stable, mechanically loadable insulating material is used, the prefabricated individual layers can be positively joined to one another by adhesive bonding. A further possibility of producing the façade components according to the invention is to position the prefabricated layers in the desired way, to perforate the still loose sandwich at several points distributed over the surface and to draw plastic anchors, which can be fixed in the zone of the fibrate concrete layers, into the perforation holes. In this case, fixing can be accomplished either by splaying or by glueing of the plastic anchors. This production method is independent of the mechanical stability of the insulating layer. Finally, it is also possible to stack the layers one above the other before the concrete sets and to introduce plastic anchors having profiled end portions into the still plastic or liquid concrete. After setting of the concrete mass, this also gives firm positive joining of the multi-layer structure. The last method is likewise independent of the mechanical stability of the insulating material and is particularly suitable for efficient mass production of the façade component according to the invention. It is therefore particularly preferred. In other respects, the use of dimensionally stable insulating materials is particularly advantageous.

The façade component according to the invention is used with particular advantage for the erection of buildings in areas where radar guidance systems are in operation, for example in the vicinity of airports.

The façade component according to the present invention is produced by positively joining at least two self-supporting flat components of fiber-reinforced concrete to one another by an interlayer of porous insulating material. A dimensionally stable, mechanically loadable flat component of porous insulating material may be used. Also, the step of positively joining may further include the use of anchors 4, as described above. Moreover, the layers may be stacked one above the other before the concrete sets, and the plastic anchors with profiled end portions may be introduced into the still plastic concrete.

We claim:

1. A self-supporting facade component in sandwich construction, composed of at least two self-supporting layers and at least one interposed insulating layer, which component is essentially metal-free, the self-supporting layers being composed of fiber-reinforced concrete and the layers being positively fixed to one another by essentially non-metallic fixing means, and wherein at least one of the self-supporting layers is a load-bearing layer and one of the self-supporting layers is a facing layer located on the outside, the facing layer and the load-bearing layer having horizontal shoulders which are mutually offset in height and which protrude into an interspace between the two layers and which are superimposed in such a way that the force of the facing layer's own weight is transmitted from its shoulder through the material of the insulating layer to the shoulder of the load-bearing layer.

2. The facade component as claimed in claim 1, wherein the insulating layer is composed of a porous inorganic material.

3. The facade component as claimed in claim 1, wherein the essentially non-metallic fixing means are plastic anchors.

4. The facade component as claimed in claim 1, wherein the load-bearing layer has a thickness from 8 to 30 cm, the facing layer has a thickness from 3 to 8 cm and the insulating layer has a thickness from 2 to 30 cm.

5. The facade component as claimed in claim 1, wherein the fiber-reinforced concrete of the self-supporting layers contains fibers in the form of continuous filaments, staple fibers, continuous or staple fiber yarns, hanks, rods, woven fabrics, knitted fabrics or nonwovens.

6. The facade component as claimed in claim 1, wherein the fiber material is present in the concrete in an average quantity from 0.1 to 10% by volume.

7. The facade component as claimed in claim 1, wherein the fiber-reinforced concrete of self-supporting layers contains fiber material of polyacrylonitrile.

* * * * *